US005178176A

United States Patent [19]

Fetterman

[11] Patent Number: 5,178,176

[45] Date of Patent: Jan. 12, 1993

[54] SLIP-RESISTANT CRUTCH TIP

[76] Inventor: Thomas Fetterman, 1122 Green St., Philadelphia, Pa. 19123

[21] Appl. No.: 716,080

[22] Filed: Jun. 17, 1991

[51] Int. Cl.[5] ..... A45B 9/04

[52] U.S. Cl. ..... 135/86

[58] Field of Search ..... 135/86, 77; 52/181

[56] References Cited

U.S. PATENT DOCUMENTS

| | | | |
|---|---|---|---|
| 710,073 | 9/1902 | Pratt et al. . | |
| 960,700 | 6/1910 | Pratt . | |
| 1,340,616 | 5/1920 | Lynde | 135/86 |
| 1,340,617 | 5/1920 | Lynde | 135/86 |
| 1,429,428 | 9/1922 | Hipwood | 135/86 |
| 3,251,372 | 5/1966 | Smith | 135/64 |
| 3,334,456 | 8/1967 | Naka | 52/181 |
| 4,881,564 | 11/1989 | Fetterman | 135/82 |

FOREIGN PATENT DOCUMENTS

| | | | |
|---|---|---|---|
| 36354 | 2/1930 | France | 135/86 |
| 121841 | 1/1919 | United Kingdom | 135/86 |
| 124673 | 4/1919 | United Kingdom | 135/86 |
| 0133215 | 10/1919 | United Kingdom . | |

OTHER PUBLICATIONS

"Ambulation Aids," *Health Devices* 20(1): 5-22, Jan. 1991.

Bennett, L. and Murphy, D. F., "Slipping Cane and Crutch Tips: Part I—Static Performance of Current Devices," *Bulletin of Prosthetics Research*, Fall 1977.

*Primary Examiner*—Henry E. Raduazo

*Attorney, Agent, or Firm*—Panitch, Schwarze, Jacobs & Nadel

[57] ABSTRACT

A crutch tip for installation on the lower end of a crutch shaft for engagement with an underlying supportig surface. The crutch tip includes a first material having a first coefficient of friction with respect to the supporting surface and a second material having a second coefficient of friction with respect to the supporting surface. The crutch tip generally includes a radial outer skirt, a ring portion radially inwardly of the skirt, and a center portion. The ring portion may be formed from the first material and the outer skirt may be formed from the second material.

6 Claims, 1 Drawing Sheet

SLIP-RESISTANT CRUTCH TIP

FIELD OF THE INVENTION

The invention relates to a crutch tip and a method for assembling a crutch tip and, more particularly, to a slip-resistant crutch tip comprising materials having differing coefficients of friction

BACKGROUND OF THE INVENTION

A crutch user faces the greatest challenge when walking on smooth, wet surfaces. For example, on a rainy or snowy day, rain water or melted snow tracked indoors makes smooth flooring, which would present little or no problem in a dry condition, particularly hazardous. The entrance flooring of many buildings is either vinyl, ceramic, or marble since these materials provide a durable, easily maintained floor surface which is generally acceptable under most conditions. However, when wet, such surfaces are hazardous to crutch users. Therefore, a durable slip-resistant crutch tip which can perform equally well under wet or dry conditions on such surfaces is required.

The ability of a crutch tip to resist slippage is a function of both the shape or configuration of the crutch tip and the material which is used to form the crutch tip, particularly the lower surface or tread piece of the crutch tip which directly engages the floor or other supporting surface. L. Bennett and E. Murphy, "Slipping Cane and Crutch Tips Part I-Static Performance of Current Devices," *Bulletin of Prosthetics Research* (Fall 1977) appraises the performance of various prior art crutch tips on a variety of surfaces.

With regard to the configuration of the crutch tip, the prior art discloses a friction crutch tip having a lower surface or tread piece which is divided or separated into a plurality of segments, each of which has an edge or portion thereof to provide a separate frictional engagement with the ground or other supporting surface when the tip is flexed. The prior art also discloses a crutch tip having a receiver for a crutch shaft and a skirt. Immediately beneath the receiver, within the skirt, are a rigid plate, an absorption or damping pad, and a ground engageable tread piece. The lower surface of the tread piece includes a plurality of downwardly or outwardly depending projections or fingers for receiving and flexing about small articles while maintaining traction with the ground or other supporting surface.

Typical prior art crutch and cane tips are made of natural rubber. Natural rubber provides superior performance on many of the varied surfaces encountered by a crutch user. However, such natural rubber crutch tips typically provide insufficient traction on smooth wet surfaces. In addition, the performance of such rubber crutch tips may be negatively influenced by such factors as the purity of the latex used in formulating the rubber, the type and quantity of fillers used in the latex, and the hardness of the cured end product.

The prior art discloses inserting one or more disks or strips of non-skid material, such as a metal wire brush, into a rubber crutch tip tread piece in order to improve traction on wet surfaces. Preferably, the non-skid material is inserted at the periphery of the tread piece, rather than in the center and may be affixed to the rubber tread piece by means such as a cementing agent, vulcanization, or a nut and bolt arrangement.

In order to improve the performance of crutch tips on wet smooth surfaces, increase uniformity and reduce cost, various materials have been tested in an attempt to replace the rubber crutch tip. However, natural rubber has an advantage on substantially dry or substantially rough surfaces in that it sloughs off its surface layer when abraded with each step and presents a clean, tacky surface to the supporting surface, in the nature of a rubber pencil eraser. Polyurethane, while an otherwise desirable material, particularly on wet surfaces, does not abrade to the same degree as natural rubber when used on a substantially dry surface, and accumulates a film of dirt, dust and other particles which limits good adhesion to the supporting surface, thereby causing a polyurethane crutch tip to be more slippery than a rubber crutch tip on substantially dry smooth surfaces. The present invention combines the self-cleaning and other advantages of natural rubber on substantially dry or substantially rough surfaces with a more and uniform polyurethane material having a high coefficient of friction on substantially smooth wet or dry surfaces.

SUMMARY OF THE INVENTION

One aspect of the present invention is a crutch tip for installation on the lower end of a crutch shaft for engagement with an underlying supporting surface. The crutch tip comprises a first material having a first coefficient of friction with respect to the surface and a second material having a second coefficient of friction with respect to the surface. The first coefficient of friction is greater than 1.0 on a substantially dry smooth surface and greater than 0.9 on a substantially wet smooth surface.

Another aspect of the present invention is a crutch tip for installation on the lower end of a crutch shaft for engagement with an underlying supporting surface. The crutch tip comprises a first material having a first coefficient of friction with respect to the surface and a second material having a second coefficient with respect to the surface, the first material being a thermoplastic.

A further aspect of the present invention is a crutch tip for installation on the lower end of a crutch shaft for engagement with an underlying supporting surface. The crutch tip comprises a tread piece having a lower surface which comprises between 40% and 60% of a first material having a first coefficient of friction with respect to a surface. The remainder of the lower surface is comprised of a second material having a second coefficient of friction with respect to the surface.

Yet another aspect of the present invention is a crutch tip for installation on the lower end of a crutch shaft for engagement with an underlying supporting surface. The crutch tip comprises a radial outer skirt, a ring portion radially inwardly of the skirt, and a center portion. The ring portion comprises a first material having a first coefficient of friction with respect to the surface and the outer skirt comprises a second material having a second coefficient of friction with respect to the surface.

Another aspect of the present invention relates to a method for assembling a crutch tip for installation on a lower end of a crutch shaft for engagement with an underlying supporting surface. The crutch tip comprises a body portion and a ring portion. The method comprises the steps of forming the ring portion from a first material having a first coefficient of friction with respect to the surface, forming the body portion from a second material having a second coefficient of friction with respect to the surface, the body portion including a seat for receiving the ring portion, and inserting the ring portion into the seat of the body portion.

BRIEF DESCRIPTION OF THE DRAWING

The foregoing summary, as well as the following detailed description of preferred embodiments of the invention, will be better understood when read in conjunction with the appended drawing. For the purpose of illustrating the invention, there is shown in the drawing embodiments which are presently preferred, it being understood, however, that the invention is not limited to the specific methods and instrumentalities disclosed. In the drawing:

FIG. 1(*a*) is an enlarged cross-sectional view of the ring portion of the crutch tip of FIG. 1;

DESCRIPTION OF THE PREFERRED EMBODIMENT

Figure 1:
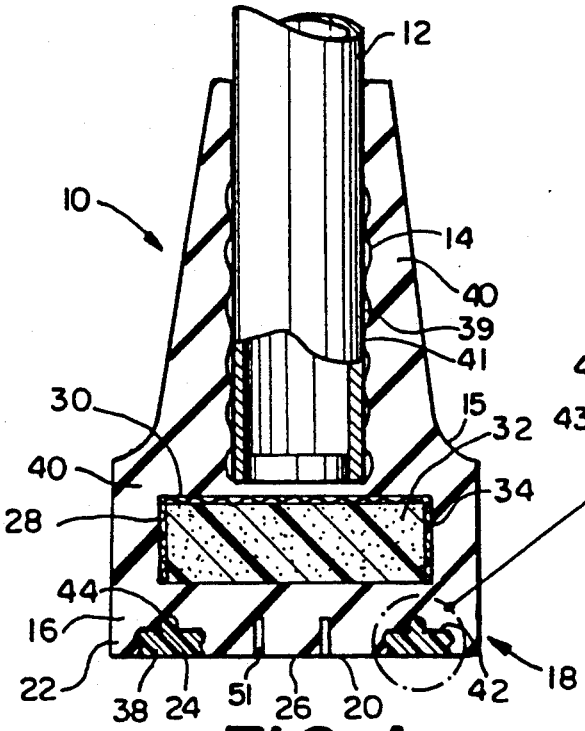
FIG. 1 is a cross-sectional view of a first embodiment of a crutch tip, in accordance with the present invention.

Certain terminology is used in the following description for convenience only and is not limiting. The words "lower", "upper", "downwardly", and "inwardly" designate directions in the drawings to which reference is made. The terminology includes the words above as specifically mentioned, derivatives thereof, and words of similar import.

Figure 2:
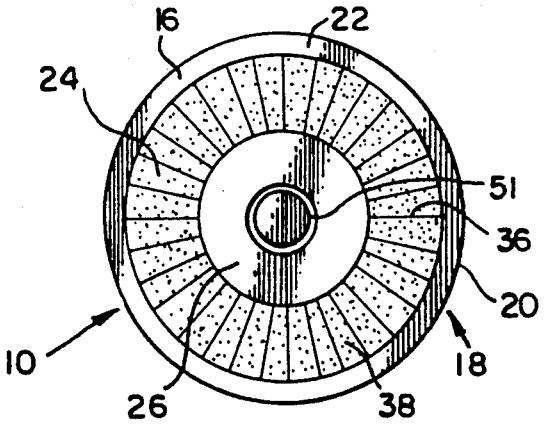
FIG. 2 is a bottom plan view of the crutch tip of FIG. 1 showing the tread piece.

Referring to the drawing, wherein like numerals indicate like elements throughout, there is shown in FIGS. 1 through 2 a preferred embodiment of a crutch tip, generally designated 10, for installation on the lower end of a crutch shaft 12 for engagement with an underlying supporting surface (not shown), such as a floor, sidewalk, street surface, stair, etc.

As shown in FIG. 1, the crutch tip 10 comprises a generally cylindrical body portion 40 having a generally upwardly tapered tubular receiver or socket 41 of rubber or a rubber-like latex material and having a generally circular bore 39 for receiving and retaining the lower end of a crutch shaft 12 therein. The crutch shaft 12 is typically formed from aluminum or some other light weight, high strength material for the long-term crutch user. However the crutch tip 10 of the present invention may also be used by a short-term crutch user, whose crutches are typically formed from a less expensive material, such as wood. The crutch shaft 12 typically has an outer diameter which is at least slightly greater than the diameter of the bore 39 so that the shaft 12 is in firm frictional engagement with the bore 39 of the socket 41. The bore 39 preferably has an interior surface 14 of a generally corrugated configuration to assist in maintaining the crutch shaft 12 in firm engagement with the socket 41, while allowing the crutch shaft 12 to be deliberately removed.

The body portion 40 of the crutch tip 10 is preferably formed from rubber. As used herein, "rubber" is defined to mean natural or synthetic rubber, such as natural rubber, polyisoprene, and other rubber-like latex materials. The body portion 40 may be defined to include a shoulder 15 which extends generally inwardly from the generally cylindrical peripheral wall 16.

In the present embodiment, it is preferred that the crutch tip 10 include a shock absorber, such as is disclosed in U.S. Pat. No. 4,881,564 of the present inventor, which is hereby incorporated by reference. The shock absorber 28 includes a generally circular rigid member or plate 30 engaged within a cavity of the body portion 40 and generally parallel to a lower surface 20 of the tread piece, indicated generally at 18. It is preferred that the plate 30 be formed from steel, aluminum or a similarly rigid material, as would be understood by one skilled in the art.

The shock absorber 28 further includes a generally cylindrical pad or cushion 32 contiguous to the underside of the plate 30 and spaced apart from the lower surface 20 of the tread piece 18. The cushion 32 may be fabricated from a polyurethane composition having high energy absorption characteristics, such as that produced under the trademark VISCOLITE, although one skilled in the art would understand that other similar shock absorption materials may be employed. The cushion 32 is generally cylindrical in configuration to conform to the size and shape of the cavity within the body portion 40. The plate 30 and cushion 32 may be wrapped around their periphery by a flexible fabric mesh or webbing 34, such as nylon or another similar material, to aid in the assembly and mechanical strength of the shock absorber 28.

As best shown in FIG. 1, the lower portion or tread piece 18 of the crutch tip 10 is comprised of a first material having a first coefficient of friction with respect to the supporting surface and a second material having a second coefficient of friction with respect to the supporting surface. In the illustrated embodiment, an annular ring portion 24 is formed of the first material and the remainder of the tread piece 18 is formed of the second material.

Preferably, the first material has a first coefficient of friction which is greater than 1.0 on a substantially dry smooth surface and greater than 0.9 on a substantially wet smooth surface. As used herein, a "substantially dry smooth surface" is defined to mean a surface on which the amount of fluid or lubricant, such as water, and the texture of the surface does not significantly influence the coefficient of friction with respect to the surface. The texture of the supporting surface of interest to the present invention is roughly analogous to that found on floor tiles or marble typically used in lobbies of buildings, for example. The term "substantially wet smooth surface" as used herein, is defined to mean a surface at least partially coated with sufficient fluid or lubricant, such as water, to influence the coefficient of friction with respect to the surface. For purposes of determining the coefficient of friction, it is preferred that the substantially wet smooth surface have a layer of water thereon, however one skilled in the art would understand that the surface may be wetted by a wide variety of lubricants, such as ice, spilled liquids such as coffee, soft drinks, etc., cleaning fluids, or any of a wide variety of fluids too numerous to mention.

The first material may be a thermoplastic, such as polypropylene or polyethylene. The preferred thermoplastic is polyurethane. Optimally, the polyurethane is the product SES 5622 sold under the trade name ICI Americas Inc. Polyurethane SES 5622 is a slip-resistant polyurethane possessing high tensile strength and high tear strength combined with low abrasive properties and offers superior traction on both wet and dry surfaces. The coefficient of friction of SES 5622, as measured using the James test, is greater than 1.0 on a substantially dry surface and greater than 0.9 on a substantially wet surface. The density of this material is approximately 1.0 to 1.1 g/cc. The hardness, as measured using the Shore A test is approximately 55. The tensile strength of this material is approximately 1700 psi with a 550 percent elongation. The tear strength, as measured according to the Trouser test, is approximately 100 pli. The material can withstand approximately 50,000 cycles of the Ross Flex test, both at room temperature and at −18° C. The abrasion loss of this material, according to the Tabor test, is approximately 40 mg/1000 cycles. These property values demonstrate the strength and wear resistance of a particular polyurethane, namely SES 5622, and the present invention is not intended to be limited to use with only polyurethane compounds or with the particularly described compound.

In order to illustrate the desirability of this particular polyurethane material versus other thermoplastic materials, it should be noted that the coefficient of friction of polystyrene with respect to itself is approximately 0.5 and with respect to steel is approximately 0.3 to 0.35. Handbook of Chemistry and Physics at F-17 (64th Ed. 1983–84). The coefficient of friction of polyethylene with respect to itself or steel is approximately 0.2. On wet snow and dry snow, at 0° C., the coefficients of friction of nylon are 0.4 and 0.3, respectively. Handbook of Chemistry and Physics at F-19. Natural rubber performs admirably on dry or substantially rough wet surfaces, such as concrete, however, on substantially wet smooth surfaces, such as vinyl flooring, the performance deteriorates.

Since the presently preferred polyurethane tends to accumulate a film of dust, dirt or other particles which impair adhesion to substantially smooth dry surfaces, it is desirable to combine the first material with a second material, such as rubber, to provide added traction on substantially smooth dry surfaces.

Preferably, the second material is rubber, although one skilled in the art would understand that other materials exhibiting rubber-like properties may be used for the second material in accordance with the present invention.

Referring now to FIGS. 1 and 2, it is preferred that the crutch tip 10 comprises a tread piece, indicated generally at 18, having a lower surface 20. In the present embodiment, it is preferred that the lower surface 20 comprises an area of between 40% and 60% of the first material with the remainder of the area of the lower surface 20 comprising the second material. Optimally, the lower surface 20 comprises 51% of SES 5622 polyurethane and 49% of latex rubber. It is desirable to have a generally even distribution of the first and second materials in the tread piece 18 to ensure superior traction on the wide variety of surfaces encountered by the typical crutch user, which may include both wet and dry surfaces.

As best shown in FIG. 2, the crutch tip 10 preferably comprises a radial outer skirt 22, a generally annular ring portion 24 radially inwardly of the skirt 22 and a generally circular center portion 26. The ring portion 24 is formed of the above-described first material having a first coefficient of friction with respect to the supporting surface. The outer skirt 22 is formed of the second material described above as having a second coefficient of friction with respect to the supporting surface. Preferably, the first coefficient of friction is greater that the second coefficient of friction when the surface is substantially wet and the first coefficient is less than the second coefficient when the surface is substantially dry.

The outer skirt 22 may be formed from rubber, such as a rubber-like latex material or natural rubber. Typically, when a crutch tip 10 is used by a crutch user, the first region of contact between the supporting surface and the tread piece 18 is on the outer edge of the tread piece 18. Since the majority of supporting surfaces encountered by the crutch user are dry, it is preferable to have a material with superior dry surface performance and good wet surface performance for the outer edge of the tread piece 18. Use of a rubber, such as rubber-like latex or a natural rubber material, is preferable because the material is readily abraded when contacted with a supporting surface and presents a clean, tacky surface with each crutch step.

As best shown in FIG. 2, it is preferred that the ring portion 24 include vanes 36. When the crutch tip 10 is used on a substantially wet surface, the vanes 36 act as vents to reduce the water pressure between the lower surface 20 of the tread piece 18 and the supporting surface in order to minimize aqua-planing. Generally, the vanes 36 extend radially outwardly across the ring portion 24, however one skilled in the art would understand that the vanes 36 may have any other configuration in keeping with the spirit and scope of the present invention. Preferably, the vanes 36 are generally equally spaced apart and extend around the entire area of the ring portion 24. The vanes 36 preferably extend into the ring portion 24 to a depth of approximately 1/16th of an inch, although one skilled in the art would understand that the vanes may extend to any depth so long as the integrity of the ring portion 24 is maintained. In the embodiment shown in FIG. 2, thirty-two vanes 36 are shown. It will be appreciated that the number of vanes, the orientation, the depth, and the spacing of the vanes may be varied. It should also be appreciated that in some embodiments, no vanes may be employed. The vanes 36 may be formed by cutting or slicing the ring portion 24, by molding the ring portion 24 with the vanes in place or in any other manner known to those skilled in the art.

In the present embodiment, the ring portion 24 preferably has a textured lower surface 38. The texture is preferably roughly equivalent to the texture of 60 grit sand paper and may be formed by using a mold surface with such a texture. The purpose of the textured lower surface is to enhance the gripping action of the lower surface 38 of the ring portion 24. It will be appreciated that any other type of textured surface may be used or that the lower ring surface 38 may be smooth, if desired.

Figure 1A:
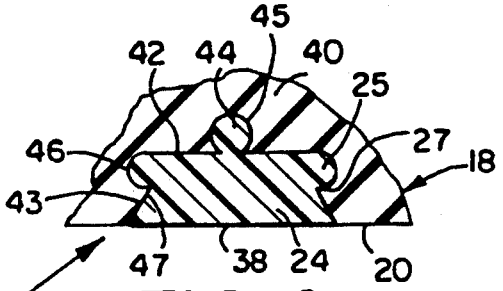

The ring portion 24 may be secured to the body portion 40 in any manner which ensures that the ring portion 24 does not separate from the body portion 40 in use. To this end, as best shown in FIG. 1*a*, it is preferred that the body portion 40 include a generally annular seat 42 for receiving the ring portion 24. The ring portion 24 may comprise a generally annular ball-shaped portion 44 for securing the ring portion 24 in a generally complementarily annularly shaped groove portion 45 within the seat 42.

The ring portion 24 may further comprise a pair of generally annular flanges 25, each flange disposed on the radial inner and outer surfaces of the ring portion 24, having an undercut shoulder 27 for securing the ring portion 24 in generally complementarily annularly shaped grooves 46 within the seat 42. In addition, the radial inner and outer surfaces of the ring portion 24 may be beveled, as indicated generally at 47, for accommodation within generally correspondingly beveled portions 43 of the seat 42 to help securely hold the ring portion 24 within the seat 42. The shape of the seat 42 generally corresponds to the shape of the ring portion 24 for accommodating the ring portion 24 therein. For added security, a layer of adhesive (not shown) may be situated between the seat 42 and ring portion 24. It should be appreciated by those skilled in the art that while the described structure of the ring portion 24 and the annular seat 42 is presently preferred, these components could have any other structure adapted to retain the ring portion 24 in position.

Referring now to FIG. 2, the center portion 26 is prefereably formed from the same material as the outer skirt 22, such as rubber or a material having similar properties to rubber. The center portion 26 may have a generally smooth lower surface or the lower surface may have a texture similar to that of the lower surface 38 of the ring portion 24. The center portion 26 may also include a ring 51 of generally circular cross-section. The ring 51 acts as a vent to reduce the water pressure between the lower surface 20 of the tread piece 18 and the supporting surface in order to minimize aqua-planing. Preferably, the ring 51 extends into the center portion 26 to a depth of approximately 3/16ths of an inch, although the skilled artisan would understand that the ring 51 may extend to any depth so long as the integrity of the center portion is maintained. The ring 51 may be formed in a manner similar to that by which the vanes 36 are formed, such as by cutting, slicing or molding, One skilled in the art would understand that more than one ring 51 may be used in accordance with the present invention and that shapes other than generally circular shapes may be used to form the ring, such as a generally square shape. It should also be understood that the center portion 26 may not include such a ring 51.

Figure 3:
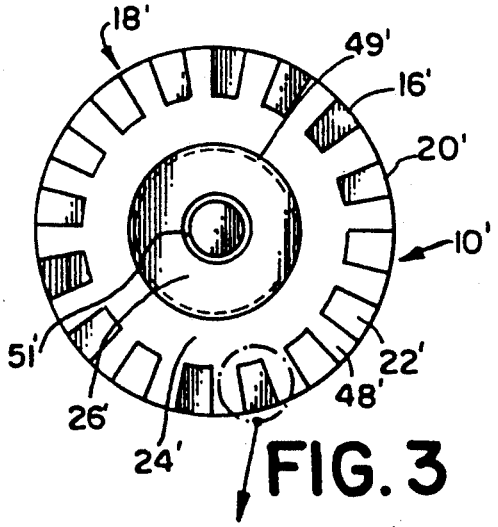
FIG. 3 is a bottom plan view of a crutch tip showing an alternative embodiment of the tread piece.
Figure 4:
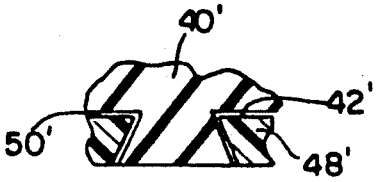
FIG. 4 is an enlarged cross-sectional view of a portion of the alternative embodiment of the tread piece, taken along line 4—4 of FIG. 3*a*.

Referring now to FIGS. 3 through 4, an alternative embodiment of the tread piece 18' of the crutch tip 10' is illustrated. In the alternative embodiment, the ring portion 24' is not textured on its lower surface and unlike the above-described embodiment does not include any vanes. However, the ring portion 24' does include a plurality of separate, generally radially outwardly extending members 48' at spaced locations around the periphery of the crutch tip 10'. In the illustrated embodiment, the members 48' extend from the outer radial circumference of the ring member 24' to the outer periphery of the skirt 22' but could be terminated short of the outer periphery, if desired.

Figure 3A:
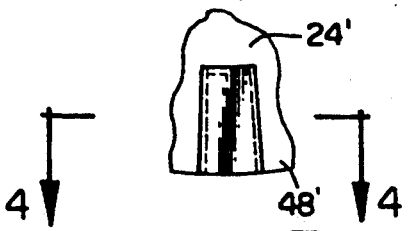
FIG. 3*a* is an enlarged bottom plan view of a portion of the crutch tip of FIG. 3.

As shown in phantom in FIG. 3*a*, the members 48' of the ring portion are beveled in order to securely position the ring portion 24' within the seat 42'. As best shown in FIG. 4, body portion 40' is correspondingly beveled to form a plurality of seats 42' to accommodate the beveled portions of members 48' of the ring portion 24' in order to securely affix the members 48' within the body portion 40'. Proximate the center portion 26', the ring portion 24' and seat 42' may be similarly beveled, the bevel 49' being indicated in phantom in FIG. 3. The center portion 26' may also include a ring 51' of generally circular cross section.

Referring to FIG. 4, in the alternative embodiment, it is preferred that adhesive means 50' be provided between each of the seats 42' and the members 48' to aid in securing the members 48' and ring portion 24' to the body portion 40'. One skilled in the art would understand that the ring portion 24' may be secured to the body portion 40' by additional or other means such as a ball and socket, as described above, or by cold casting, or by any other means in keeping with the spirit and scope of the present invention.

The method for assembling the crutch tip 10 of FIGS. 1–2 comprises the steps of forming the ring portion 24 from the first material and separately forming the body portion 40 from the second material. The body portion 40 includes a seat 42 for receiving the ring portion 24, as described above. The final assembly step includes inserting the ring portion 24 into the seat 42 of the body portion 40.

Preferably, the step of forming the body portion 40 includes assembly of the shock absorber 28. The shock absorbing cushion 32 is preferably fabricated by casting. The plate 30 may be punched from a steel sheet, and the side of the plate 30 to be aligned facing the body portion 40 may be coated with an adhesive (not shown). The cushion 32 and plate 30 may be aligned and the periphery of the cushion 32 and plate 30 subsequently encircled by the webbing 34. The details of the formation of the components or assembly of the shock absorber 28 are considered to be not particularly relevant nor limiting to the present invention and further discussion therefore is not deemed to be necessary.

The step of forming the body portion 40 preferably also includes die-cutting pieces of rubber or a rubber-like latex material to fabricate the outer skirt 22 and center portion 26 of the tread piece 18. The socket area of the outer skirt 22 is formed by die-cutting generally cylindrically shaped pieces of rubber having an aperture therethrough corresponding to the section of the outer skirt 22 in the region of the socket 41, and stacking the pieces by aligning the apertures to form the socket area.

The area of the outer skirt 22 which accommodates the shock absorber 28 is formed by cutting first and second generally cylindrical shaped pieces of rubber joined by a strip of rubber therebetween, the strip being generally perpendicular to the axis of each cylinder and having a width and length sufficient to encase the periphery of the shock absorber 28. The webbing 34 is placed in facing engagement with the strip. The first cylinder is placed in facing engagement with a side of the plate 30 opposite the cushion 32 and the second cylinder is placed in facing engagement with the side of the cushion 32 opposite the plate 30. The strip encircles the periphery of the plate 30 and cushion 32 with the webbing 34 in facing engagement with the plate 30 and cushion 32 peripheries.

The tread piece portion of the outer skirt 22 is formed by die-cutting a generally cylindrically shaped piece of rubber, having an aperture for receivably accommodating the ring portion. The center portion 26 of the tread piece 18 is formed by die-cutting a generally cylindrically shaped piece of rubber. The tread piece portion of the outer skirt 22 is placed in facing engagement with the side of the second cylinder opposite the cushion 32 adjacent the periphery of the second cylinder. The center portion is also placed in facing engagement with the side of the second cylinder opposite the cushion 32, but it is centered within the periphery defined by the aperture of the tread piece portion of the outer skirt 22.

Preferably, individual assembled body portions 40 are placed in individual cavities within a multi-cavity mold formed of a rigid material, such as steel. The mold is heated to a predetermined temperature and pressure to integrate the pieces of the body portion 40 together. The details of temperature, pressure and other processing parameters for forming the body portion 40 of the crutch tip 10 are considered to be within the knowledge of one of ordinary skill in the art of crutch tip formation and further discussion thereof is not believed to be necessary. One skilled in the art would understand that the body portion 40 may be formed in a variety of ways other than the example set forth above.

After the body portion 40 has cooled to ambient temperature, approximately 50° F. to 80° F., and the material has cured, individual molded body portions 40 are generally interconnected in the area of the tread piece portion by a thin layer of excess molded rubber or flashing. The molded body portions 40 must be separated from each other to form the individual crutch tips 10 by cutting the flashing around the periphery of the tread piece portion, such as by use of a trimming die press. One skilled in the art would understand that the flashing may be trimmed by a variety of manual or automatic cutting means such as by use of a knife or scissors.

As presently preferred, the trimming die press consists of first and second generally parallel surfaces. The first surface includes apertures generally corresponding to the number and configuration of the cavities in the mold. The inner edge of each aperture includes a thin steel rim for supporting the inverted molded body portion 40 of each crutch tip 10 and a cutting blade for trimming the flashing. The first surface is movable mounted on a pair of rails to allow movement in a direction generally parallel to the second surface to facilitate loading and unloading of the body portions 40 from the press.

The second surface includes a series of generally cylindrical cutting blades generally corresponding in number and configuration to the cutting blades of the first surface. Inside and generally parallel to each cutting blade is a generally cylindrical steel ring positioned directly over the seat 42 and having a wall generally narrower than the width of the seat 42 for positioning the ring portion 24 within the seat 42.

The flashing from the molded body portion 40 is trimmed and the ring portion 24 inserted into the seat 42 by use of the trimming die press. The inverted molded body portions 40 are inserted into the apertures in the first surface and the ring portion 24 of each tip 10 is correspondingly positioned thereon. The method may further comprise providing an adhesive 50 between the seat 42 and the ring portion 24 for securing the ring portion 24 within the seat 42. The first surface is then loaded in corresponding alignment with the second surface. The second surface is moved towards the first surface such that the knives of the first and second surfaces intermesh to sever the flashing from each body portion 40 and the generally cylindrical ring inserts the ring portion 24 into the seat 42. One skilled in the art would understand that other methods may be used for assembling the body portion 40 and ring portion 24 and trimming the flashing. For example, the ring portions 24 may be cold-cast in a configuration generally similar to the mold configuration. The interconnected ring portions 24 may therefore be conveniently positioned onto the body portions 40 and the flashing between the ring portions 24 trimmed during insertion of the ring portions 24 into the seats 42.

From the foregoing description, it can be seen that the present invention comprises a crutch tip and a method for assembling a crutch tip comprising materials having differing coefficients of friction for forming a durable and inexpensive crutch tip having superior performance on the many varied surfaces encountered by a crutch user. It will be appreciated by those skilled in the art that changes could be made to the embodiment described above without departing from the broad inventive concept thereof. It is understood, therefore, that this invention is not limited to the particular embodiment disclosed, but is intended to cover all modifications which are within the spirit and scope of the invention as defined by the appended claims.

I claim:

1. A crutch tip for installation on the lower end of a crutch shaft, the crutch tip comprising a tread piece for engagement with an underlying supporting surface, the tread piece comprising a radial outer skirt, a ring portion radially inwardly of the skirt, and a center portion, the ring portion comprising a first material having a first coefficient of friction with respect to the surface and the outer skirt comprising a second material having a second coefficient of friction with respect to the surface, the first coefficient of friction being greater than the second coefficient of friction when the surface is substantially wet and the first coefficient of friction being less than the second coefficient of friction when the surface is substantially dry.

2. A crutch tip according to claim 1, wherein the ring portion includes vanes.

3. A crutch tip according to claim 2, wherein the vanes extend radially outwardly across the ring portion.

4. A crutch tip according to claim 1, wherein the ring potion comprises a textured lower surface.

5. A crutch tip according to claim 1, wherein the crutch tip includes a body portion including a seat for receiving the ring portion, the ring portion comprising a ball portion for securing the ring portion in the seat.

6. A crutch tip according to claim 1, wherein the center portion comprises rubber.

* * * * *